United States Patent [19]

Krause

[11] 4,081,011

[45] Mar. 28, 1978

[54] TUBULAR CONTAINER WITH SUSPENSION ELEMENTS

[76] Inventor: Walter Krause, D-7121 Waldheim (Wurttemberg), Germany

[21] Appl. No.: 759,854

[22] Filed: Jan. 17, 1977

[30] Foreign Application Priority Data

Mar. 12, 1976 Germany ..... 7607644

[51] Int. Cl.[2] ..... A45C 9/00

[52] U.S. Cl. ..... 150/1; 150/12; 222/181

[58] Field of Search ..... 150/.5, 1, 12; 222/181

[56] References Cited

U.S. PATENT DOCUMENTS

| | | | |
|---|---|---|---|
| D. 140,519 | 3/1945 | Pascal | 150/1 |
| 676,659 | 6/1901 | Mogg | 150/12 |
| 733,542 | 7/1903 | Converse | 150/12 |
| 1,251,404 | 12/1917 | Mills | 150/12 |
| 2,019,197 | 10/1935 | Spanel | 150/1 |
| 3,292,813 | 12/1966 | Roegner | 150/1 |
| 3,567,110 | 3/1971 | Susuki | 150/12 |
| 3,976,113 | 8/1976 | Kim | 150/12 |
| 4,008,806 | 2/1977 | de Paez | 150/1 |

FOREIGN PATENT DOCUMENTS

| | | | |
|---|---|---|---|
| 172,530 | 10/1934 | Switzerland | 150/1 |
| 360,733 | 11/1931 | United Kingdom | 150/1 |
| 371,271 | 4/1932 | United Kingdom | 150/1 |
| 1,317,398 | 5/1973 | United Kingdom | 150/1 |

*Primary Examiner*—R. E. Hart

*Attorney, Agent, or Firm*—Michael J. Striker

[57] ABSTRACT

A container of a pliable material comprises a tubular wall having an upper marginal portion, an upper end wall connected to the marginal portion of the tubular wall, and two suspension elements located opposite to one another and connected to the marginal portion of the tubular wall. Each of the suspension elements forms a loop having an interior and is provided with two side edge portions spaced from one another in a transverse direction and laterally bounding the interior. Each of the side edge portions is provided with a hem fixedly connected to the marginal portions of the tubular wall by means of seams. The seams comprise at least two first seams extending in a longitudinal direction of the suspension elements and spaced from one another in the transverse direction and at least two second seams intersecting one another and extending between the first seams at an angle to the latter.

10 Claims, 3 Drawing Figures

TUBULAR CONTAINER WITH SUSPENSION ELEMENTS

BACKGROUND OF THE INVENTION

The present invention relates to a container of a pliable material. More particularly it relates to such a container which comprises a tubular wall, an upper end wall connected to an upper marginal portion of the tubular wall, and two suspension elements located opposite to one another and also connected to the upper marginal portion of the tubular wall.

Containers of this type are already known in the art. In such a container each of the suspension elements forms a loop having an interior and is provided with two side edge portions spaced from one another in a transverse direction and laterally bounding said interior.

The suspension elements are so located that they extend along the respective opposite sides of the quadrangular upper end wall and are connected to the upper marginal portions of the tubular wall of the container by means of seams extending parallel to upper edges of the upper end wall. Each of the side edge portions of the suspension elements is further connected to the marginal portion of the tubular wall by means of rivets located one after another in a longitudinal direction of the respective suspension element parallel to a side edge thereof. Since the suspension elements is so formed that the side edge portions are normal to the respective sides of the upper end wall, therefore a length of the respective suspension elements in the transverse direction remains uniform along the entire suspension element and equal to the length of the respective side of the upper end wall along which said suspension element extends.

It is understood that the connection of the suspension elements to the tubular wall of the container, while using the latter, is subjected to hight stresses. It has been recognized that in the conventional containers of the afore-mentioned type the upper rivets provided on the side edge portions of the suspension elements have a tendency to be torn out, while subjected to inclined forces produced by loading of the container. This results in that such a container has a reduced carrying capacity and therefore it may not be further loaded with a load of required weight. At the same time, the connection of the suspension elments to the tubular wall may be entirely destroyed during the further use of the container, which reduces a life-time of the container.

SUMMARY OF THE INVENTION

Accordingly, it is an object of the present invention to provide an improved container which avoids the afore-mentioned disadvantages.

More particularly, it is an object of the present invention to provide an improved container which has a longer life-time than the conventional containers of this type.

Another object of the present invention is to provide an improved container which preserves a predetermined carrying capacity during entire time of its use.

Still another object of the present invention is to provide an improved container with suspension elements which do not tend to be torn out from the peripheral wall of the container.

In keeping with these objects, and with others which will become apparent hereafter, a container, in accordance with th present invention, briefly stated, comprises a tubular wall having an upper marginal portion, an upper end wall, connected to the marginal portion of the tubular wall, and two suspension elements located opposite to one another and connected to the marginal portion of the tubular wall. Each of the suspension elements forms a loop having an interior and is provided with two side edge portions spaced from one another in a transverse direction and laterally bounding the interior. Each of the side edge portions is provided, in turn, with a hem fixedly connected to the marginal portion of the tubular wall by means of seams. The seams comprise at least two first seams extending in a longitudinal direction of the suspension element and spaced from one another in the transverse direction and at least two second seams intersecting one another and extending between the first seams at an angle to the latter.

The tubular wall has an upper edge, and each of the second seams has an upper end portion closest to the upper edge of the tubular wall. The upper end portions of the second seams are provided with a respective locking seam extending substantially parallel relative to one another.

Each of the locking seams has an upper end closest to the upper edge of the tubular wall and a lower end downwardly spaced from the upper end. The locking seams extend at an acute angle relative to the side edge portion of the respective suspension element so that the upper end of each of the locking seams is spaced from the side edge portion of the suspension element by a distance greater than the distance by which the lower end of the same locking seam is spaced from the same side edge portion.

The tubular wall may be cylindrical. It also may be prismatic, and the upper end wall may be rectangular or square.

Each of the suspension elements has two lower marginal parts connected to the tubular wall and a looped upper part forming a handle. The side edge portions of each of the suspension elements are slanted relative to one another so that each of the lower marginal parts of the suspension element is of a length exceeding the length of the upper part thereof in the transverse direction.

In a container having a quadrangular upper end wall, each of the lower marginal portions of the suspension element extends along the respective lateral side of the upper end wall and is of a length less than the length of this lateral side of said wall in the transverse direction.

The first seams connecting the hem to the tubular wall of the container comprise one seam inwardly spaced from the other in the transverse direction. A third seam is also provided, connecting the hem with the respective associated suspension element, which third seam extends in the longitudinal direction in alignment with the one seam of the first seams so as to form therewith a composite seam.

The novel features which are considered as characteristic for the invention are set forth in particular in the appended calims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
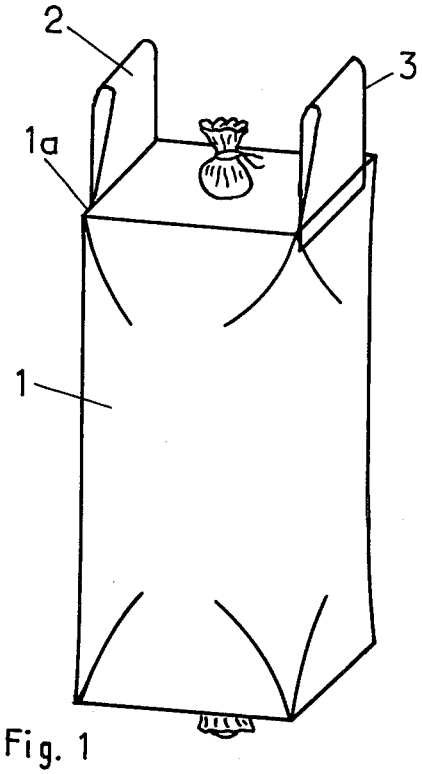
FIG. 1 illustrates a container in accordance with the present invention.
Figure 3:
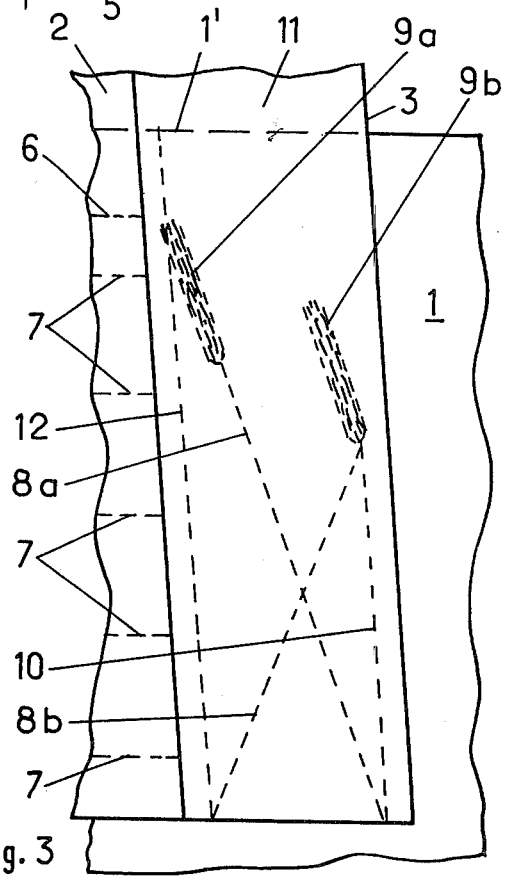
FIG. 3 is an enlarged fragmentary view of FIG. 2 showing a connection of the suspension element to the tubular wall of the container.

A container, in accordance with the present invention, is shown in FIG. 1 and comprises a tubular wall 1 and an upper end wall connected to an upper marginal portion of the tubular wall. The tubular wall 1 may be cylindrical. It also may be prismatic, as particularly shown in FIG. 1. In the latter case the upper end wall is quadrangular, and may be either rectangular, or square.

Figure 2:
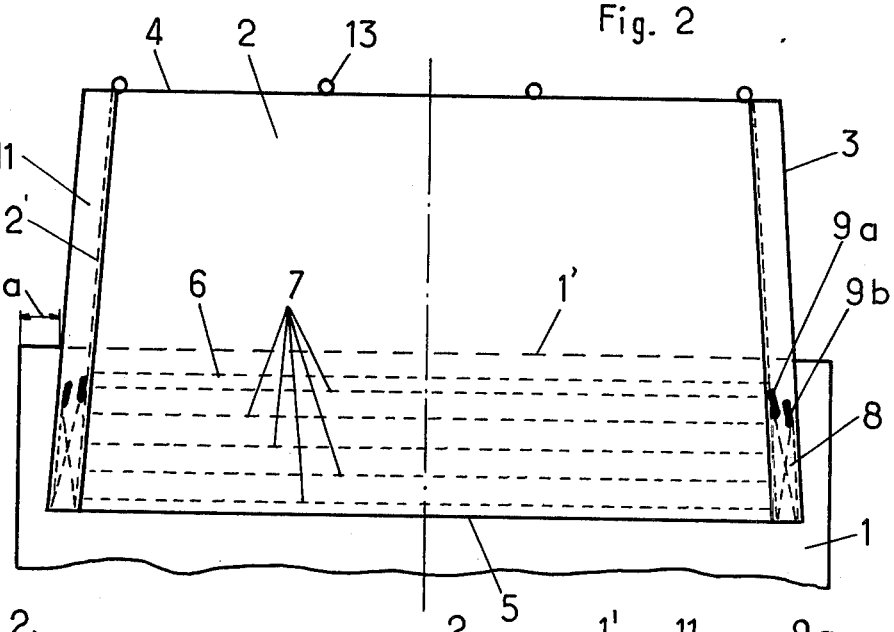
FIG. 2 is an enlarged view showing a suspension element connected to a tubular wall of the container.

Two suspension elements 2 are provided located opposite one another and connected to the upper marginal portion of the tubular wall 1 so that each suspension element 2 extends along the respective side 1' of the quadrangular upper end wall. The suspension elements 2 are made of a pliable material, and each of these elements forms a loop and has two side edge portions 3 spaced from one another in a transverse direction. As clearly shown in FIG. 2 of the drawing, the side edge portions 3 of each suspension element 2 are slanted relative to one another in longitudinal direction so that each of the lower marginal parts 5 of this element is of a length exceeding the length of an upper part 4 thereof in the transverse direction. Each suspension element 2 is formed by bending of a pliable strip and thereafter connecting the thus bent-out part thereof to one another by means of a seam 6 extending substantially parallel to the lower marginal part 5 of the respective suspension element 2.

The parts of the material of each suspension element 2 located along the side edge portions 3 thereof are turned so as to form hems 11 each of which is fixed to the rest part of the respective suspension element 2 by means of a longitudinal seam 12'. Each suspension element 2 is connected to the tubular wall 1 by means of a row of seams 7 each extending between the two hems 11 of the same suspension element 2 and parallel to the lower marginal portion 5 of the latter.

Each hem 11 of the suspension elements 2 is connected to the tubular wall 1 by means of two first seams identified by reference numerals 10, 12 and two second seams identified in toto by reference numeral 8. The first seams 10, 12 extend in a longitudinal direction of the respective suspension element 2 and substantially parallel to one another, whereas the second seams 8*a*, 8*b* intersect one another and extend between the first seams 10, 12. The seams 10, 12, 8*a* and 8*b* form a figure approximating to a rectangle or a trapezium, which diagonals are defined by seams 8*a* and 8*b*.

Upper end portions of the second seams 8*a*, 8*b* are reinforced by means of locking seams 9*a*, 9*b*, respectively, extending substantially parallel relative to one another. At the same time, the locking means 9*a*, 9*b* extend at an acute angle relative to the respective side edge portion 3 of the suspension element 2 so that an upper end of each of the locking seams 9*a*, 9*b* is spaced from the side edge portion 3 by a distance greater than the distance by which a lower end of the same locking seam 9*a*, 9*b* is spaced from the same side edge portion 3.

An uppermost seam of the row of seams 7 is located slightly below the seam 6, which seam 6 connects the parts of the suspension element 2 to one another, so that a space is provided between the seam 6 and the side 1' of the upper end wall adapted for mounting a protective flap between the suspension element 2 and said side 1'.

The longitudinal seam 12' may extend in alingment with the seam 12 inwardly spaced from seam 10 so that the longitudinal seam 12' forms with the seam 12 a composite seam.

In the illustrated example a length of the lower marginal portion 5 of each suspension element is less than the length of the respective side 1' of the upper end wall. It has been found that in this case the connection of the suspension elements 2 to the tubular wall 1 is subjected to lesser stresses, and particularly at the end points thereof, that is over the seams 9*a*, 9*b*.

Since the lower marginal part 5 of each suspension element 2 has the length less than the length of the respective side 1' of the upper end wall, and the side edge portions of this suspension element 2 are slanted relative one another in the longitudinal direction, each of the side edge portions 3 of the suspension element 2 is spaced from the respective end point of the side 1' of the upper end wall in the transverse direction by a small distance identified by reference numeral 1*a*.

The upper part 4 of each suspension element 2 forming a handle of the same is provided with reinforcing members 13 which reinforcing members spread apart the suspension element 2 and thereby facilitate entering of this element.

The afore-disclosed container in accordance with the present invention possesses essential advantages. It has a longer life-time than the conventional containers of this type. It preserves a predetermined carrying capacity during the entire time of its use. The suspension elements of the container do not tend to be torn out from the tubular wall thereof.

It will be understood that each of the elements described above, or two or more together, may also find a useful application in other types of construction differing from the types described above.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A container of a pliable material, comprising a tubular wall having an upper marginal portion and an upper edge; an upper end wall connected to said marginal portion of said tubular wall; and two lifting sleeves located opposite and substantially parallel to one another and connected to said marginal portion of said tubular wall, each of said lifting sleeves forming a loop continuously extending in a transverse direction of said tubular wall and having an interior extending in said transverse direction, each of said lifting sleeves having two side edge portions spaced from one another in a transverse direction and laterally bounding said interior, each of said side edge portions being provided with a hem fixedly connected to said marginal portion of said tubular wall by means of seams comprising at least two first seams extending in a longitudinal direction of said lifting sleeves and spaced from one another in said transverse direction and at least two second seams intersecting one another and extending between said first seams at an angle to the latter, each of said second seams having an upper end portion closest to said upper edge of said tubular wall and provided with a locking seam extending substantially parallel to the locking seam of the other second seam.

2. A container as defined in claim 1, wherein said first seams are parallel relative to one another.

3. The container as defined in claim 1, wherein said tubular wall is cylindrical.

4. The container as defined in claim 1, wherein said tubular wall is prismatic.

5. The container as defined in claim 4, wherein said upper end wall is rectangular.

6. The container as defined in claim 4, wherein said upper end wall is square.

7. The container as defined in claim 1, wherein each of said locking seams has an upper end closest to said upper edge of said tubular wall and a lower end downwardly spaced from said upper end, said locking seams extending at an acute angle relative to said side edge portion of the respective lifting sleeve so that said upper end of said locking seam is spaced from said side edge portion by a distance greater than the distance by which said lower end of the same locking seam is spaced from the same side edge portion.

8. The container as defined in claim 1, wherein each of said lifting sleeves has two lower marginal parts connected to said tubular wall and a looped upper part forming a handle, said side edge portions of each of said lifting sleeves being slanted relative one another so that each of said lower marginal parts is of a length exceeding the length of said upper part in said transverse direction.

9. The container as defined in claim 1, wherein said upper end wall is quadrangular and bounded by lateral sides, each of said lifting sleeves having two lower marginal portions each extending along the respective lateral side of said upper end wall and being of a length less than the length of said lateral side in said transverse direction.

10. The container as defined in claim 1, wherein said first seams comprise one seam inwardly spaced from the other in said transverse direction; and further comprising a third seam connecting each of said hems with the associated lifting sleeve, said third seam extending in said longitudinal direction in alignment with said one seam of said first seams so as to form therewith a composite seam.

* * * * *